US012663171B1

(12) United States Patent
Cline

(10) Patent No.: US 12,663,171 B1
(45) Date of Patent: Jun. 23, 2026

(54) DUAL-FUNCTION WATER-VAPOR CAPTURE DEVICE

(71) Applicant: Thomas Cline, Seattle, WA (US)

(72) Inventor: Thomas Cline, Seattle, WA (US)

( * ) Notice: Subject to any disclaimer, the term of this patent is extended or adjusted under 35 U.S.C. 154(b) by 0 days.

(21) Appl. No.: 19/546,287

(22) Filed: Feb. 21, 2026

(51) Int. Cl.

| | |
|---|---|
| ***F24F 3/14*** | (2006.01) |
| ***F24F 1/00*** | (2019.01) |
| *F24F 1/0083* | (2019.01) |
| *F24F 1/0358* | (2019.01) |
| *F24F 6/00* | (2006.01) |
| *F24F 11/00* | (2018.01) |

(52) U.S. Cl.
CPC ..... *F24F 3/1417* (2013.01); *F24F 1/0083* (2019.02); *F24F 1/0358* (2019.02); *F24F 3/14* (2013.01); *F24F 2003/144* (2013.01); *F24F 6/00* (2013.01); *F24F 11/0008* (2013.01); *F24F 2203/02* (2013.01); *F24F 2203/1024* (2013.01)

(58) Field of Classification Search
CPC ..... F24F 3/1417; F24F 1/0083; F24F 1/0358; F24F 3/14; F24F 3/144; F24F 2003/144; F24F 2203/02; F24F 2203/1024; F24F 6/00
See application file for complete search history.

(56) References Cited

U.S. PATENT DOCUMENTS

| | | | | |
|---|---|---|---|---|
| 4,171,624 | A * | 10/1979 | Meckler | F25B 15/06 62/271 |
| 4,723,417 | A * | 2/1988 | Meckler | F24F 3/1423 62/271 |
| 5,048,200 | A * | 9/1991 | Ryham | D21F 1/48 34/473 |
| 10,539,334 | B2 * | 1/2020 | Sakikawa | B01J 20/24 |

FOREIGN PATENT DOCUMENTS

| | | | | |
|---|---|---|---|---|
| WO | WO-9932841 | A2 * | 7/1999 | B01D 53/263 |
| WO | WO-2022263794 | A1 * | 12/2022 | F24F 1/039 |

* cited by examiner

*Primary Examiner* — Youngsul Jeong

(57) ABSTRACT

An apparatus that dehumidifies an enclosed airspace by compressing air into a first reactor, where the water-vapor component of the air accelerates liquefaction of calcium-chloride granules, and by also compressing air into a second reactor where a saturated solution of calcium chloride from the first reactor absorbs water vapor from the air through a sparging process, which enables a continuous absorption of water vapor by an increasingly diluted solution to a point of diminished marginal utility.

8 Claims, 4 Drawing Sheets

DUAL-FUNCTION WATER-VAPOR CAPTURE DEVICE

BACKGROUND OF THE INVENTION

The general field of art to which this invention belongs is the dehumidification of an indoor airspace by using an inorganic salt such as calcium chloride as a desiccant. The purpose of dehumidification technology is to irreversibly capture water-vapor molecules. A technology fulfilling this purpose will approach optimality to the extent it maximizes the rate of water-vapor capture, maximizes the ratio of water vapor captured to desiccant consumed, and minimizes the consumption of electrical energy.

A building is considered to have an optimal level of humidity for human habitation if the relative humidity of its indoor airspace is between 40 and 60 percent. A relative humidity greater than 60 percent becomes increasingly optimal for other species, including microbes, arthropodal parasites, and fungi. A high level of indoor humidity is not only inimical to human habitation but also to the structural integrity of the building, particularly if there emerge colonies of mold. Improvements in dehumidification technology are needed and would be especially beneficial in cool marine climates.

The prior art of dehumidification includes two categories, each characterized by a different thermodynamic strategy. Electric dehumidifiers and air conditioners cause water vapor to change its state to liquid water, which is then sequestered from the airspace. Desiccants react with water vapor to yield a hydrated solid or an aqueous solution, both of which contain intermolecular attractive forces that inhibit captured water from re-vaporizing.

Electric dehumidifiers can be effective during warm temperatures, but there is evidence that they increasingly lose their effectiveness as the temperature of an airspace cools below the comfort zone. The use of a desiccant is therefore a better strategy for an airspace which is not always kept at a comfort-zone temperature-including attics, crawlspaces, basements, outbuildings, commercial buildings, and vacation homes. Calcium chloride has been and will continue to be the best choice as a desiccant because of its affordability, availability, effectiveness, and low toxicity.

The prior art of airspace desiccation limits itself to vessels for handling both the desiccant and the hydrated products of the desiccation reaction. A common function of these vessels is to enable a desiccant to passively interact with the airspace. The vessels are otherwise not configured to accelerate the desiccation reaction nor to utilize the desiccant more economically. Typically, the hydrated products are discarded or, in the case of an adsorbing material such as silica gel, dehydrated for reuse by means of a process that consumes energy and re-vaporizes the adsorbed water.

Solid calcium chloride is hygroscopic and deliquescent, so it will react with water vapor spontaneously, first to yield hydrates in the form $CaCl_2)(H_2O)_n$ then to yield an aqueous solution where each molecule of calcium chloride dissociates into one calcium cation and two chloride anions. The rates of these reactions will be influenced by the rate at which water-vapor and calcium-chloride molecules interact. Diffusion alone will ensure a certain minimum availability of water vapor, but an optimal desiccation strategy will employ a method to increase the rate of interaction.

An optimal desiccation strategy will also make use of the saturated solution. This is because a saturated calcium-chloride solution will continue to absorb water vapor until its solvent vapor pressure becomes equal to the partial pressure of water vapor within the contiguous airspace. It is possible to derive a good approximation of how much more water vapor can be captured from an airspace during this dilution process. Raoult's Law and its modern refinements inform us that a solvent vapor pressure of an aqueous solution at a given temperature is a product of two factors: the vapor pressure of pure water at that temperature and an amount-of-substance fraction defined as moles of molecular entities within the solvent divided by moles of molecular entities within the solution. For illustrative purposes, molecular entities within the solvent can appropriately be limited to water molecules because water dissociates into hydrogen ions and hydroxide ions at a low rate under terrestrial conditions within a calcium-chloride solution. The universe of molecular entities within a calcium-chloride solution would therefore, to a good approximation, consist of water molecules, calcium ions, and chloride ions.

It is possible to make quantitative comparisons between saturated and dilute calcium-chloride solutions by assuming that the vapor pressure of pure water is constant and by varying the proportion of water molecules among the molecular entities constituting the solution. Let w be the number of molecular entities contributed to the solvent by one water molecule and assign to that variable a value of 1. Let c be the number of molecular entities contributed to the solute by one molecule of calcium chloride and assign to that variable a value of 3, one ion for each of the three atoms constituting the calcium-chloride molecule. A solvent vapor pressure of 25 percent, corresponding closely to the saturation vapor pressure of a calcium-chloride solution at a cool above-freezing temperature, will come into existence if water contributes to the solution one molecule for every three ions contributed to the solution by calcium chloride. This result becomes apparent by substituting appropriate values into Raoult's amount-of-substance fraction:

$$\frac{w}{w+c} = \frac{1}{1+3} = 25\%$$

A solvent vapor pressure of 50 percent would be an appropriate equilibrium point for a dilution process as it would imply that the contiguous airspace has reached a salutary level of relative humidity. This level of solvent vapor pressure will come into existence when the number of water molecules within the solution triples, resulting in three water molecules for every three ions contributed to the solution by calcium chloride:

$$\frac{3w}{3w+c} = \frac{3}{3+3} = 50\%$$

A desiccation process can therefore conserve calcium chloride by transferring water molecules into the saturated solution directly from the airspace.

Because there is a continuous exchange of air between the interior of a structure and its surroundings—a rate of one complete air change every three hours being considered optimal—the success of a desiccation strategy will depend upon how quickly water-vapor molecules are absorbed into the calcium-chloride solution. A technique known as sparging, a forced dispersion of a gas into a liquid, offers a promising way to accelerate that process. Sparging proved its effectiveness in nineteenth-century metallurgy with the invention of the Bessemer Process, a technique of pumping air into molten pig iron to combust carbon and other impurities. The Bessemer Process produced a more ductile variety of steel and dispensed with a previous need for dangerous hand-tool production techniques. Sparging also proved its effectiveness in the second half of the twentieth century as a remedy against eutrophication. It accomplished this by accelerating the absorption of oxygen into stagnant lake water. Sparging has also proven its effectiveness at removing volatile petrochemicals from contaminated soils.

There will be a net transfer of water molecules from an airspace into a contiguous aqueous solution whenever the partial pressure of water vapor within the airspace exceeds the solvent vapor pressure of the solution. The rate of this absorption will be directly proportional to the total interface area between the airspace and the solution, all other factors being held constant. The total interface area will not only become larger during a sparging process but also become increasingly larger as the average bubble size decreases. This is a consequence of the cardinality of water-vapor molecules within a bubble (a metric for bubble volume at constant temperature, pressure, and water-vapor concentration) diminishing in proportion to an inverse cube of a decrease in radius while the bubble surface area diminishes only in proportion to an inverse square of the decrease in radius. The effect of these different rates of exponential change can be illustrated by defining a function of the radius as a ratio of surface area ($4\pi r^2$) to volume ($4\pi r^3/3$) for a sphere having a radius of r. This function simplifies to the expression $$f(r) = \left(\frac{A}{V}\right)_r = \frac{3}{r}$$

which defines a hyperbola having a negative slope for all positive values of r. An implication of this inverse relationship is that bubble surface area per water-vapor molecule becomes larger with each decrease in radius while an average distance between a water-vapor molecule and the bubble surface becomes smaller. These simultaneous changes have a compounding effect as they both strengthen the intermolecular attractive forces between the water-vapor molecules within the bubble and the molecular entities within the solution that are arrayed upon the bubble surface. As these attractive forces increasingly strengthen, the expected waiting time for absorption of a water-vapor molecule away from the bubble and into the solution diminishes. This accounts for the increased rate of water-vapor absorption enabled by the sparging process.

BRIEF SUMMARY OF THE INVENTION

This invention optimizes the capture of water vapor from an indoor airspace by using a flow of compressed air to accelerate the liquefaction of calcium-chloride granules and by injecting air into the resulting aqueous solution to maximize the ratio of water vapor captured to calcium chloride consumed. An embodiment of this invention designed for household use will consume about the same wattage as an LED luminaire.

This invention is scalable for use in a single room or in a large building. If the invention finds use within a house or a small commercial establishment, its most preferred embodiment would be a single assembly of all specified parts together with a holding tank and with plumbing fixtures that enable the apparatus to drain into a waste-water system of the building. The liquefaction reactors could be configured to be easily removable for recharging with calcium-chloride granules. Fully charged liquefaction reactors could even be sold in retail stores.

A connection to a waste-water system would certainly not be optimal if the invention is used in a structure that does not have such a system and may not be optimal even within a structure that does. In these situations the preferred embodiment would be a portable unit of a weight and girth that enables it to be carried by a single person. The portable unit would include a holding tank with an attached drainage valve or an access port for a siphon. If the portable unit contains an adequately sized holding tank and operates within a well enclosed and reasonably small airspace, there would be an infrequent need for servicing.

This invention is particularly suitable for locations that are inconvenient to access but nevertheless in need of effective dehumidification. Although the invention does consume calcium-chloride granules, the operation of the dilution reactor allows for the lowest rate of calcium-chloride consumption within the thermodynamic limitations of the desiccation process. By including a larger number of liquefaction reactors and by also including a dehumidistat to restrict operation of the apparatus to particularly humid intervals, the apparatus could continue to effectively dehumidify an airspace without servicing for an entire season or more, particularly if the apparatus is connected to the waste-water system of the building and the vapor and water barriers surrounding the airspace are in reasonably good condition.

Although there is a need for a source of compressed air, an aquarium pump operating at eight watts, more or less, would likely be adequate for a smaller airspace such as an unventilated attic of a single-family home. Even a small air flow in a range of hundreds of liters per hour, if it is continuous, will produce beneficial results. The cost of power to operate this invention will therefore be negligible compared to the benefits.

DETAILED DESCRIPTION OF THE INVENTION

Figure 1:
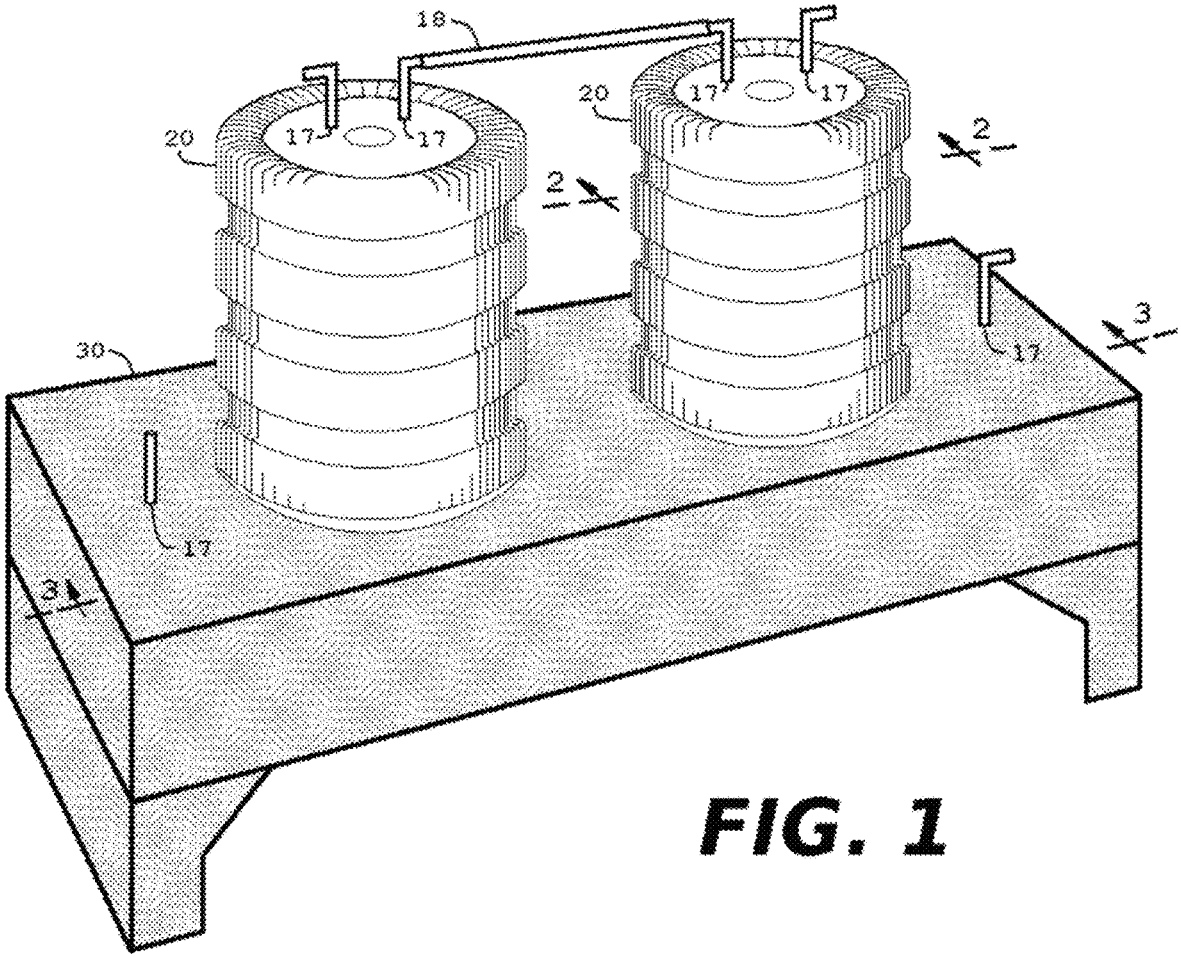
FIG. 1 is a perspective view of one of the many possible configurations of liquefaction reactors and dilution reactors that enable the apparatus to process solid calcium chloride into a diluted aqueous solution.
Figure 2:
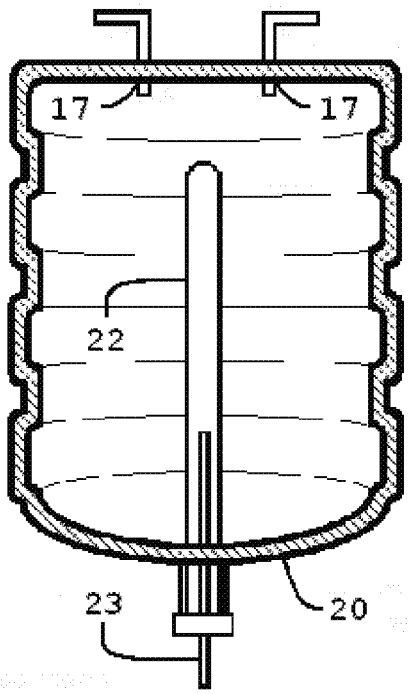
FIG. 2 is a sectional view of a liquefaction reactor in FIG. 1.
Figure 3:
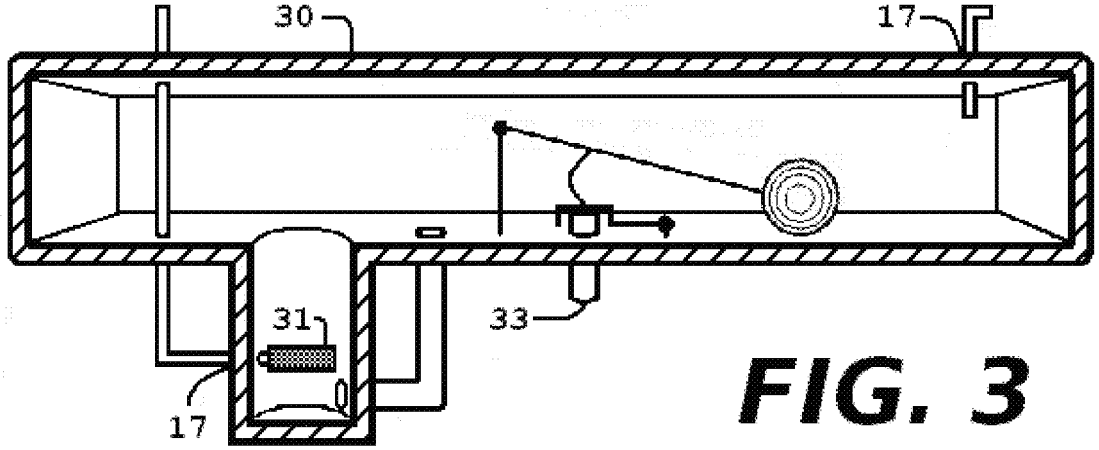
FIG. 3 is a sectional view of the dilution reactor in FIG. 1.
Figure 4:
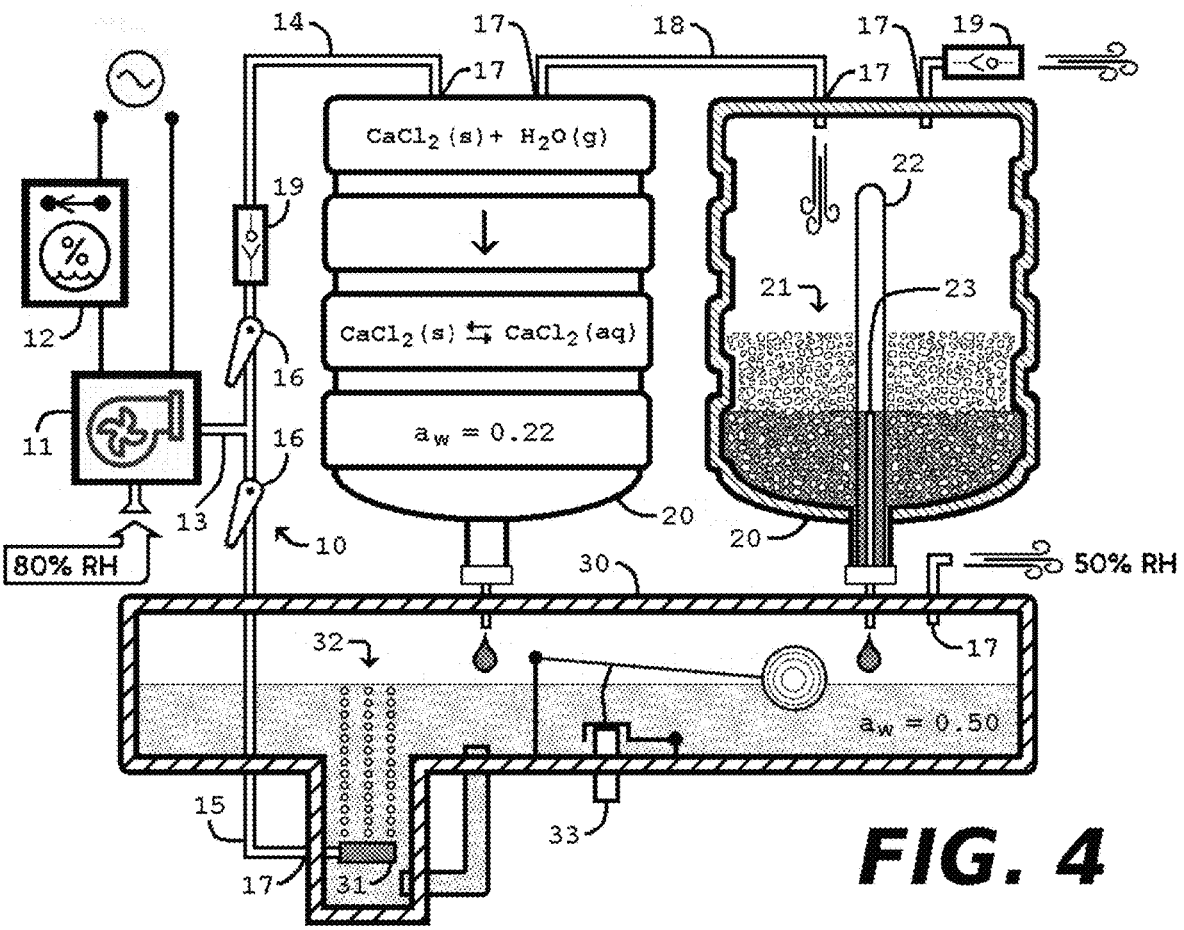
FIG. 4 is a composite view of schematic and pictorial images that illustrates functional interactions among the claimed elements of this invention. Included in this view are legends that specify plausible relative-humidity values for intake air and for processed air, a formula for the chemical reaction that occurs within the liquefaction reactor, and designations of the different water-activity (aw) values expected for solutions within the liquefaction reactor and the dilution reactor.
Figure 5:
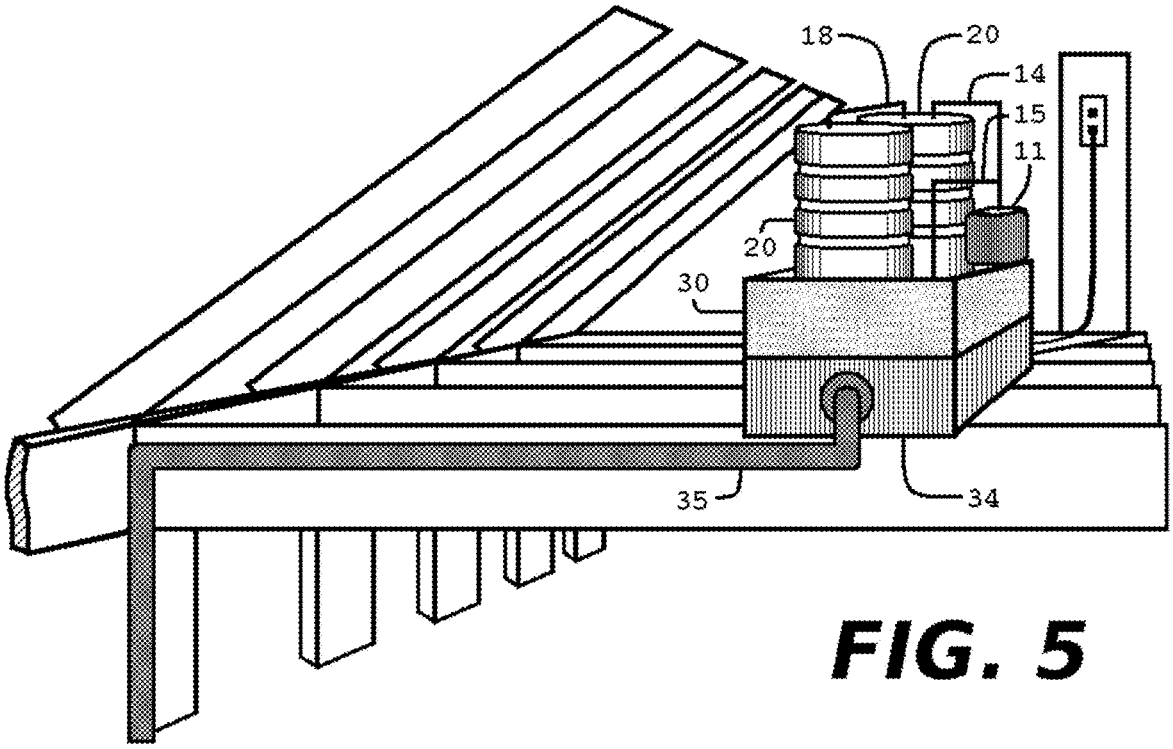
FIG. 5 is a perspective view of a preferred embodiment of the invented apparatus as it would be installed advantageously within an attic.

This description pertains to specific preferred embodiments of this invention and should not be construed as a limitation upon the combinations and configurations that fall within the scope of the claims.

The invented apparatus includes three components: a liquefaction reactor 20 that enables reactions between water vapor and a hygroscopic substance 21 (referred to hereinafter as the preferred substance calcium chloride), a dilution reactor 30 that enables reactions between water vapor and an aqueous solution of calcium chloride, and a pneumatic system 10 that supplies compressed air to both reactors.

A preferred embodiment of this invention features an electric air pump 11 as the outlying upstream element of the pneumatic system 10. Compressed air impelled by the air pump 11 enters into ducting which forks into two channeled air streams. This ducting may include an intermediate duct 13 immediately upstream from the fork. The ducting downstream from the fork includes a primary channeled air stream 14 that channels air to the liquefaction reactor 20 and a secondary channeled air stream 15 that channels air to the dilution reactor 30. A stopcock 16 would be positioned within each of the two channeled air streams, just after the fork, to enable an adjustment of air flow to each reactor. Channeled air from the ducting will enter and exit each reactor by way of a pneumatic port 17.

The pneumatic system 10, in its most advantageous configuration, will contain a dehumidistat 12 to control operation of the electric air pump 11. The set point of the dehumidistat 12 would be a desired level of relative humidity within the airspace. This setting will reduce consumption of both electric power and calcium chloride to amounts minimally necessary to reach that level. Whenever an increase of temperature or a decrease of water-vapor concentration within the airspace causes the relative humidity of the airspace to fall below the set point, the air pump 11 will cease to operate until the relative humidity of the airspace rises once again above the set point.

The initial contents of the liquefaction reactor 20 comprise calcium-chloride granules 21. Water-vapor laden air traveling from the air pump 11 to the liquefaction reactor 20 will sustain a reaction between calcium-chloride granules 21 and water-vapor molecules that yields as its product a saturated aqueous solution of calcium chloride. If more than one liquefaction reactor 20 is included within the apparatus, additional ducting 18 will interconnect the liquefaction reactors to maintain the flow of air within secure channels. There are check valves 19 positioned so that the flow of air into and out of each liquefaction reactor 20 will stop if the air pump 11 ceases to operate. This will arrest the liquefaction process and preserve calcium-chloride granules 21 from further consumption when the relative humidity of the airspace falls to the level indicated by the set point of the dehumidistat 12. A slurry containing the saturated solution and calcium-chloride granules 21 will begin to form as the reaction proceeds. The weight of the saturated solution will cause it to pass through a filter 22 and into a dual-purpose access and transfer port 23 through which it will exit from the liquefaction reactor 20.

Gravity or a pump will move the saturated solution into the dilution reactor 30 where it pools over an aerial diffuser 31. Water-vapor laden air from the air pump 11 flows through the aerial diffuser 31 and into the saturated solution in the form of multitudinous bubbles 32. The saturated solution absorbs water vapor from these bubbles 32. Then, after the bubbles 32 burst at the surface of the saturated solution, the newly dehydrated air exits from the dilution reactor 30 through a pneumatic port 17 and into the airspace, lowering its relative humidity.

Because of its continuous absorption of water vapor from the sparged air, the newly diluted solution will experience an increasingly larger volume, an increasingly higher solvent vapor pressure, and an increasingly higher water-activity level. But in contrast to those trends, the water-vapor absorption rate will diminish, approaching zero asymptotically as the dilution process continues. At some indefinite moment during the dilution process, the value of maintaining a high rate of water-vapor absorption will begin to outweigh the value of further efforts to conserve calcium chloride. The moment will arrive sooner if the relative humidity of the airspace remains persistently above a desired level. When that moment occurs, the solution within the dilution reactor 30 will cease to have pragmatic utility. This would imply a need to drain the dilution reactor 30 to enable additional inputs of saturated solution from the liquefaction reactor 20. If a valve 33 is used for this purpose, a preferred embodiment of this invention will include a float valve that opens automatically when the internal energy of the increasingly voluminous solution applies sufficient work against a buoyant lever. A holding tank 34 could be added to the dilution reactor 30 to receive the drained solution. This would reduce the frequency of needed servicing if a siphon is used as an ultimate drainage tool. But it may be convenient to install piping 35 to connect either the dilution reactor 30 or a holding tank 34 to a waste-water system.

This invention is suitable for use as a mold-deterrence device, although it must be recognized that even the most efficient desiccation system cannot prevent a growth of indoor mold if a temperature within an airspace falls to the level of a dew point. This invention will, however, provide a margin of effectiveness by removing a substantial number of water-vapor molecules from the airspace, which will reduce the dew-point temperature to a lower level. Nevertheless, the prospect of mold growth cannot be entirely eliminated without some means of ensuring that the temperature of the airspace remains above that lower dew point.

An optimal margin of effectiveness can be attained if this invention operates as a catchment for captured water vapor within the temperature-regulating mold-deterrence method specified in U.S. Pat. No. 11,561,045, "Power Supply and Method to Deter Mold," which is hereby incorporated by reference into this specification. In this particular mode of operation the air pump 11 would be included among a plurality of devices that connect to and are controlled by the "fans outlet" of the power-supply apparatus specified in U.S. Pat. No. 11,561,045.

What is claimed is:

1. An apparatus to dehumidify air within an enclosed space wherein the apparatus comprises:

(a) a hygroscopic substance, (b) at least one liquefaction reactor which comprises a function to enable water vapor to react with the hygroscopic substance to yield an aqueous solution, (c) at least one dilution reactor which comprises a function to enable water vapor to react with the aqueous solution to yield a more diluted aqueous solution, (d) at least one source of compressed air, (e) a primary channeled air stream which comprises an upstream connection to the at least one source of compressed air and a downstream connection to the at least one liquefaction reactor, (f) a secondary channeled air stream which comprises an upstream connection to the at least one source of compressed air and a downstream connection to the at least one dilution reactor, and (g) a configuration which comprises the primary channeled air stream and the secondary channeled air stream both connecting to the at least one source of compressed air directly or by way of an intermediate duct, which intermediate duct comprises an upstream opening that is connected to the at least one source of compressed air and a downstream opening which is connected to the primary channeled air stream and to the secondary channeled air stream.

2. The apparatus of claim 1, wherein the at least one source of compressed air comprises at least one electric air pump.

3. The apparatus of claim 2, which further comprises a dehumidistat that energizes the at least one electric air pump when a relative humidity of an airspace becomes greater than a relative humidity indicated by a set point upon the dehumidistat and de-energizes the at least one electric air pump when the relative humidity of the airspace becomes less than the relative humidity indicated by the set point upon the dehumidistat.

4. The apparatus of claim 1, wherein the at least one liquefaction reactor comprises:

(a) a chamber comprising a casing that envelops a space, (b) a loading port which comprises a function to enable an insertion of the hygroscopic substance into the chamber, (c) a transfer port which comprises either the loading port or a discrete port and also comprises a function to enable the aqueous solution to exit from the chamber by operation of a valve or by operation of a passive drainage assembly, (d) an upstream pneumatic port which comprises a function to enable the primary channeled air stream to enter into the chamber, and (e) a downstream pneumatic port which comprises a function to enable the primary channeled air stream to exit from the chamber.

5. The apparatus of claim 4, wherein the passive drainage assembly comprises:

(a) a seal which comprises an axial hole, a configuration to entirely overlay the transfer port, and a hermetic interface with the casing, (b) a drainage duct which comprises a longitudinal shape, an impermeable wall, openings at both extremities, an orientation characterized by partial insertion through the axial hole into the chamber, and a hermetic interface with the seal at the axial hole, which hermetic interface with the seal either fixes the drainage duct to the seal or allows for adjustment of distances of the two extremities from the seal, and (c) a filter which comprises permeability to liquid, impermeability to particles exceeding a certain girth, and a configuration to completely envelop the partial insertion of the drainage duct through the axial hole into the chamber.

6. The apparatus of claim 1, wherein the at least one dilution reactor (a) a vessel which comprises a continuous and impermeable encasement of a space, except at locations where transfers of substances occur by volition, and a shape and a size that enable a repose of a volume of liquid, (b) at least one inflow aperture which comprises a function to enable an insertion of liquid into the vessel, (c) at least one aerial diffuser which comprises a location of low elevation within the vessel, an inlet that is connected through a pneumatic port upon the vessel to the secondary channeled air stream, an outlet that divides the secondary channeled air stream into a plurality of smaller air streams, and a function that enables the plurality of smaller air streams to flow into and through a liquid reposed within the vessel, (d) at least one pneumatic port which comprises a function to enable air to exit from the vessel and to merge with air external to the apparatus, and (e) at least one drainage aperture which comprises a function to enable liquid to exit from the vessel.

7. The apparatus of claim 6, wherein the at least one drainage aperture comprises a valve.

8. The apparatus of claim 7, wherein the valve comprises a function to automatically open when a surface of a liquid reposed within the vessel reaches a certain maximum high elevation and to automatically close when the surface of the liquid reposed within the vessel reaches a certain minimum low elevation.

* * * * *